United States Patent [19]

Hiller

[11] Patent Number: 4,730,091

[45] Date of Patent: Mar. 8, 1988

[54] ALARM SWITCH

[76] Inventor: Glenn Hiller, 231 Westwood Ave., Staten Island, N.Y. 10314

[21] Appl. No.: 852,767

[22] Filed: Apr. 16, 1986

[51] Int. Cl.[4] ..... H01H 21/40

[52] U.S. Cl. ..... 200/74; 116/82; 200/61.93; 200/276; 200/325

[58] Field of Search ..... 200/74, 276, 325, 61.93, 200/67 C; 116/83, 89, 82, 87

[56] References Cited

U.S. PATENT DOCUMENTS

| | | | |
|---|---|---|---|
| 1,208,503 | 12/1916 | Cruice | 116/83 |
| 2,567,421 | 9/1951 | Brantingson | 200/276 |
| 3,244,847 | 4/1966 | Erpel | 200/276 |
| 3,567,882 | 3/1971 | Beck | 200/61.93 |

FOREIGN PATENT DOCUMENTS

| | | | |
|---|---|---|---|
| 80468 | 3/1919 | Switzerland | 116/82 |

*Primary Examiner*—Henry J. Recla
*Assistant Examiner*—Renee S. Luebke
*Attorney, Agent, or Firm*—Richard L. Miller

[57] ABSTRACT

An alarm device is provided consisting of a non-conductive base with two conductive inserts, a latch mechanism integral to a base and a trip device which is connected to a coil spring. A set of L-shaped legs are attached to each end of the coil spring and one leg coacts with the latch mechanism and is released when the trip device is activated, and the other leg coacts with one of the inserts and the coil spring coacts with the other when the trip device is activated.

1 Claim, 2 Drawing Figures

ALARM SWITCH

BACKGROUND OF THE INVENTION

This invention relates to security devices and more particularly to an alarm switch.

Security devices often require complex and therefore expensive systems which require specific expertise to install. Many such devices require mounting in windows and doors and are not portable. Furthermore, although a variety of types exist, it is common for many of these units to require breakage to be activated. Resetting is therefore impossible.

Therefore there exists a need for an alarm device which is inexpensive to manufacture, install and will be reusable.

SUMMARY OF THE INVENTION

It is an object of this invention to provide a new and improved alarm device.

It is another object of the invention to provide a new and improved alarm device with a spring contact.

It is yet another object of this invention to provide a new and improved alarm device with a trip latch.

It is still another object of this invention to provide a new and improved alarm device with a set of contact inserts.

It is a further object of this invention to provide a new and improved alarm device with mounting holes.

It is still further object of this invention to provide a new and improved alarm device which can be reset.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
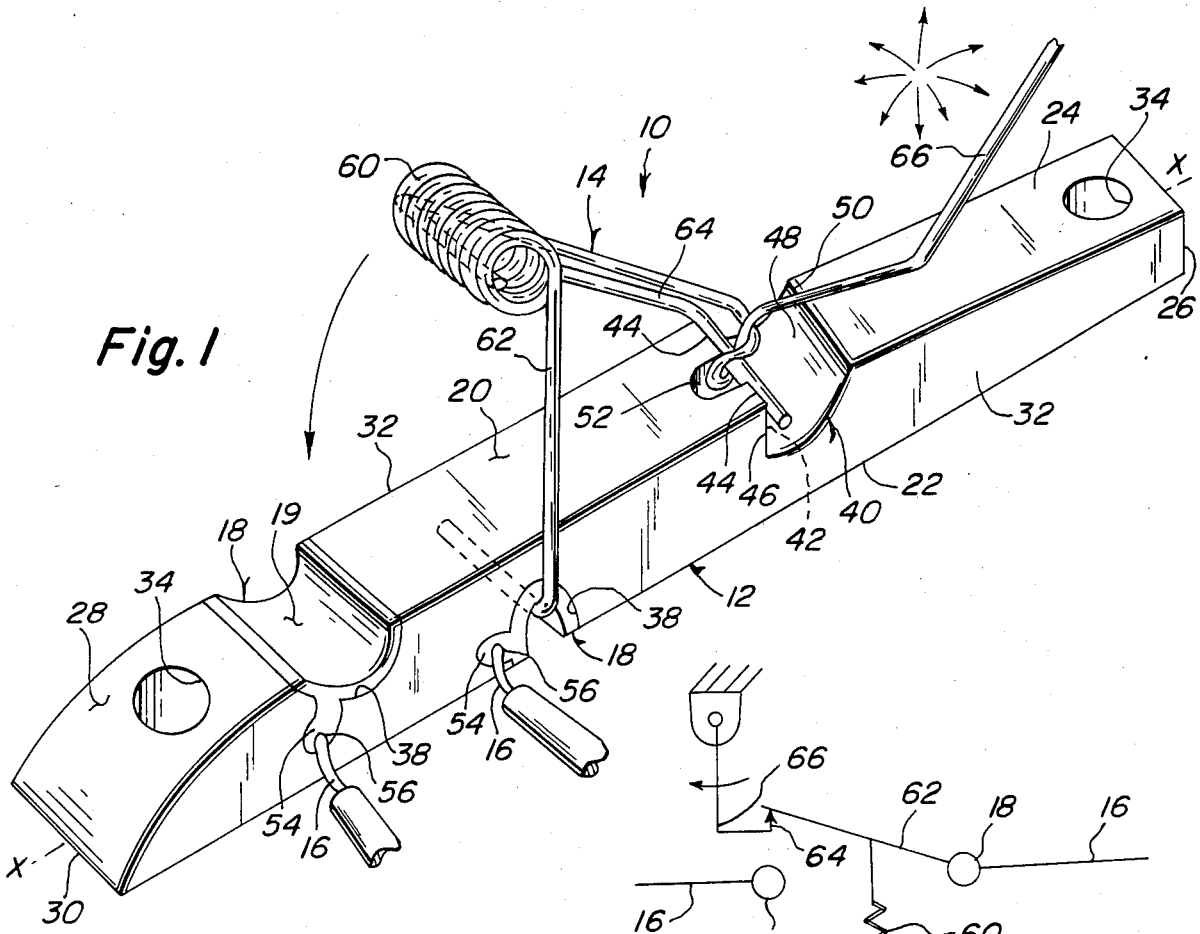
FIG. 1 is a perspective view of the invention with parts broken away.

With reference to FIG. 1 there is generally shown alarm switch 10, consisting of a base 12 in the form of an irregular elongated parallelepiped of material which is electrically non-conductive, a trip device 14 of electrically conductive material and pre-designed form, a pair of electrical leads 16 and a pair of inserts 18. Base 12 has a first top surface 20 of rectangular form parallel to a bottom surface 22 of rectangular form, a second top surface 24, an end 26, a third top surface 28, an edge 30 and a pair of sides 32. The shape of the side 32 is irregular and is formed of three connected plane geometry figures as follows, a quarter circule adjacent top surface 28, a rectangle adjacent top surface 20, and a trapezoid adjacent to top surface 24. A pair of mounting holes 34 perpendicular to the plane formed by bottom surface 22, are located along axis of symmetry X—X and one hole is located in second top surface 24 proximate end 26 and the other hole is located in second top surface 28 proximate edge 30. Inserts 18 of electrically conductive material are disposed in a pair of grooves 38 in a form to coact with grooves 38. One insert 18 is disposed between first top surface 20 and third top surface 28 and, the other insert 18 is disposed in bottom surface 22 proximate first top surface 20.

A latch groove 40 has a first surface 42 (not shown) disposed, starting at an edge 44 of first top surface 20 of base 12 to a pre-determined depth equal to an edge 46. Surface 44 is mutually perpendicular to sides 32 and first top surface 20 and a second surface 48 of latch groove 40 is in the form of a segment of a cylinder interseating the bottom of first surface 42 and an edge 50 of second top surface 24. A latch clearance slot 52 is disposed at edge 44 and develops into first top surface 20 a predetermined distance to effect coaction with trip device 14. Clearance slot 52 is in the form of a half cylinder perpendicular to first top surface 20. Each insert 18 has a tab 54 with a tab hole 56 which coacts with lead 16.

Trip device 14 has central to its form a coil spring 60 with a contact leg 62 in the form of an L-shape disposed from one end of coil spring 60 and disposed from the other end is a latch 64 also in the form of an L-shape. A trip lever 66 is affixed to latch 64 and formed in a complex shape pre-designed to coact with coil spring 60 and latch groove 40.

When coil spring 60 is disposed with its two L-shapes each in their respective latched position that is in insert 18, and latch groove 40, the spring is being held with its bias energy attempting to force these two L-shapes toward each other. In operation it is this bias which forces the L-shape which is in latch grove 40 to slide relative to surface 20, and thus cause coil spring 60 to snap into surface 19 of insert 18.

Figure 2:
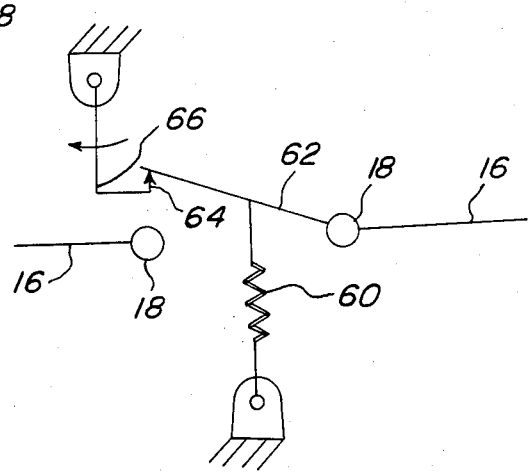
FIG. 2 is a schematic representation of the invention thereof.

In FIG. 2 the operation is schematically shown. Trip lever 66 is activated in response to an external force placed upon it in any direction, releasing latch 64, thereby causing spring 60 to reposition itself into insert 18. Continuity is thereby established between the two inserts 18 which are connected to electrical leads 16 which may connect to conventional alarm circuity etcetera.

While certain novel features of this invention have been shown and described and are pointed out in the annexed claims, it will be understood that various omissions, substitutions and changes in the forms and details of the device illustrated and in its operation, can be made by those skilled in the art without departing from the spirit of the invention.

What is claimed is:

1. An alarm switch, comprising, a non-conductive base, a pair of conductive inserts received on said base, trip means received on said base, a conductive spring means received on said base and coacting with said trip means and said inserts, latch means received on said base which coacts with said trip means, each of said conductive inserts being disposed for connection to a conductive member, and said trip means, said latch means and said spring means coacting such that a predetermined movement of said trip means operates said latch means and causes said spring means to electrically connect said inserts one to another, and said spring means is in a form of a coil spring with a first L-shaped contact leg proximate a first end of said coil spring which coacts with a first insert of said conductive inserts, and a second L-shaped leg proximate a second end of said coil spring which coacts with said latch means, and said coil spring coacts with a second insert of said conductive inserts when said trip means is activated, thereby establishing electrical contact between said first insert and said second insert.

* * * * *